US006026276A

United States Patent [19]

Malachowski

[11] Patent Number: 6,026,276

[45] Date of Patent: Feb. 15, 2000

[54] APPARATUS FOR HANDLING COLOR TRANSPARENCIES USING VACUUM SWITCHING

[76] Inventor: Michael A. Malachowski, 8594 Sun Vista Dr., Cordova, Tenn. 38018-3565

[21] Appl. No.: 08/939,554

[22] Filed: Sep. 29, 1997

[51] Int. Cl.[7] ..... G03G 15/00

[52] U.S. Cl. ..... 399/400; 271/197

[58] Field of Search ..... 399/45, 67, 68, 399/122, 320, 321, 322, 330, 331, 389, 397, 400; 271/196, 197, 202, 270, 276

[56] References Cited

U.S. PATENT DOCUMENTS

| | | | |
|---|---|---|---|
| 5,031,002 | 7/1991 | Yaguchi | 399/400 |
| 5,063,415 | 11/1991 | Ariyama | 399/400 |
| 5,138,392 | 8/1992 | Kinoshita et al. | 399/45 |
| 5,166,735 | 11/1992 | Malachowski | 399/400 X |
| 5,461,467 | 10/1995 | Malachowski | 399/381 |
| 5,652,943 | 7/1997 | Matsuo | 399/389 X |
| 5,809,368 | 9/1998 | Menjo et al. | 399/400 X |

*Primary Examiner*—William Royer
*Assistant Examiner*—Hoan Tran
*Attorney, Agent, or Firm*—John M. Kelly

[57] ABSTRACT

An apparatus for advancing at least two different types of substrates from a moving surface to a fusing station is disclosed. A constant speed transport positioned to receive the substrate from the moving surface advances the substrate to the fusing station. An air moving device moves air such that air pressure induces a drive force on the substrate on the transport. A sensor generates a first signal when the substrate is of a first type and generates a second signal when the substrate is of a second type. The air moving device induces a first drive force when the sensor generates the first signal and induces a second drive force when the sensor generates the second signal.

12 Claims, 3 Drawing Sheets

APPARATUS FOR HANDLING COLOR TRANSPARENCIES USING VACUUM SWITCHING

The present invention generally relates to a copy media transport system in an electrophotographic printing machine, and more particularly it concerns a sheet transport system for conveying color transparencies to a fusing station.

In a typical electrophotographic process, a portion of a photoconductive member is charged by a corona device to a substantially uniform potential to sensitize the surface thereof. The charged portion is then exposed to a light pattern of an original image to selectively discharge the surface in accordance with the light pattern. The resulting pattern of charged and discharged areas on the photoconductive member form an electrostatic charge pattern known as a latent image. The latent image is then developed by contacting it with a dry or liquid developer material having a carrier and toner. The toner is attracted to the image areas and held thereon by the electrostatic charge on the surface of the photoconductive member. Thus, a toner image is produced in conformity with a light pattern. The toner image is transferred to a copy media, and the image affixed thereto to form a permanent record of the image to be reproduced. Subsequent to development, excess toner left on the photoconductive member is cleaned from its surface. The process is useful for light lens copying from an original document or for printing electronically generated or stored originals, such as with a raster output scanner (ROS), where a charged surface may be imagewise discharged in a variety of ways.

The foregoing discussion generally describes a typical black and white or single color electrophotographic printing process. The approach utilized for multicolor electrophotographic printing is substantially the same. However, instead of forming a single latent image on the photoconductive member, multiple latent images corresponding to different color separations are sequentially recorded on the photoconductive member. Each single color latent image is then developed with toner complimentary thereto. This process is repeated for each of the differently colored images with a respective toner of a complimentary color. Thereafter, each single color toner image is transferred to the copy media in superimposed registration with the prior toner image, creating a multi-layered toner image. This multi-layered toner image is permanently affixed to the copy media in a conventional manner to form a finished color copy.

In the foregoing type of printing machine, the toner image formed on the photoconductive member is transferred to a copy media which may be paper or any of a variety of transparencies including paper backed, border striped, and borderless types. Prior to fusing the transferred toner image is typically only loosely applied to the copy media. It is easily disturbed by stripping the copy media from the photoconductive member and by moving the copy media to a fusing station. The copy media preferably passes through the fusing station soon after transfer to fuse the powder image permanently to the copy media. One type of suitable fusing station is a roll-type fuser, wherein the copy media is passed through a pressure nip existing between two rolls, at least one of which is heated and at least one of which is resilient.

Fusing systems that fuse transparencies, particularly with colored toner thereon, run at a speed that is generally one-half of the prefuser transport process speed. The longer dwell time of the nip, the nip pressure, and the fuser operating temperature are such that the toners are adequately melted and smoothed to the degree necessary to produce acceptable high chroma transparencies. Chroma refers to the quality of the images projected by the color transparency. In other words, the colors of a projected transparency should represent a faithful color reproduction of the original images.

The prefuser vacuum transport (PFT) of the present invention conveys color transparencies to the fuser. At appropriate times, the PFT vacuum fan turns off and then back on to allow slippage between the color transparency and the PFT drive belt. This prevents the color transparency from buckling and being wrapped around the fuser roll and causing copy smear on the transparency. The PFT maintains a constant process speed so as to avoid costly and unreliable two speed switching devices (i.e., clutches, gears, and etc.).

For a color printing machine to find wide acceptance in the market place, it is necessary that it be able to reproduce glossy or matte copies and high chroma transparencies. Moreover, it is necessary, that is able, to do so without increasing the cost of the printing machine to the customer and without utilizing excessive space in the machine.

The following disclosures may relate to various aspects of the present invention.

U.S. Pat. No. 5,166,735
Patentee: Malachowski
Issued: Nov. 24, 1992
U.S. Pat. No. 5,461,467
Patentee: Malachowski
Issued: Oct. 24, 1995

The disclosures of the above-identified patents may be briefly summarized as follows:

U.S. Pat. No. 5,166,735 discloses a sheet transport incorporating a control for matching drive speeds imparted to a copy media extended between a fuser roll nip and an image transfer area. The transport contains a vacuum plenum that communicates with a receiving surface on the transport. The copy media is engaged by the transport and is adhered to the receiving surface by the vacuum. The fuser rolls are driven at a slightly higher speed to tension the copy media and lift it from the transport surface. The lifting is detected by a sensor that senses the vacuum in the plenum and accordingly adjusts the drive speed of the fuser rolls.

U.S. Pat. No. 5,461,467 discloses a printing machine in which a copy media receives a developed image from a photoconductive member exerting a holding force on the sheet to move the sheet therewith. A transport is positioned to receive the sheet leading edge as the sheet leaves the photoconductive member. The transport exerts a drive force on the sheet in the same direction as the holding force exerted on the sheet by the photoconductive member. A controller in communication with the transport regulates the drive force while also maintaining the sheet in tension and causing the sheet to slip on the transport until the sheet trailing edge leaves the photoconductive member.

Pursuant to the features of the present invention, there is provided an apparatus for advancing at least two different types of substrates from a moving surface to a fusing station. A constant speed transport positioned to receive the substrate from the moving surface advances the substrate to the fusing station. An air moving device moves air such that air pressure induces a drive force on the substrate on the transport. A sensor generates a first signal when the substrate is of a first type and generates a second signal when the substrate is of a second type. The air moving device induces a first drive force when the sensor generates the first signal, and induces a second drive force when the sensor generates the second signal.

In accordance with another aspect of the present invention, there is provided an apparatus for advancing a transparency from a moving surface to a fusing station having at least one fuser roll. A transport positioned to receive the transparency from the moving surface advances the transparency to the fusing station. An air moving device moves air such that air pressure induces a drive force on the transparency on the transport. A sensor generates a signal when the transparency is sensed. A controllable power supply drives the air moving device. A timer connected to the sensor and the power supply turns the power supply off for a period of time when the sensor senses the transparency. The drive force drops below a buckle resist force causing the transparency to slip on the transport and prevents the transparency from wrapping around the fuser roll.

In accordance with yet another aspect of the present invention, there is provided a printing machine of the type in which a transparency receives a developed image from a moving surface exerting a holding force thereon and advancing said transparency to a fusing station having at least one fuser roll. The improvement includes a transport for receiving the transparency from the moving surface and for advancing the transparency to the fusing station. An air moving device moves air such that air pressure induces a drive force on the transparency on the transport. A sensor generates a signal when the transparency is sensed. A controllable power supply drives the air moving device. A timer connected to the sensor and to the power supply turns off the power supply for a period of time when the sensor senses the transparency. The drive force drops below a buckle resist force causing the transparency to slip on the transport and preventing the transparency from wrapping around the fuser roll.

Other features of the present invention will become apparent as the following description proceeds and upon reference to the drawings, in which.

Figure 1:
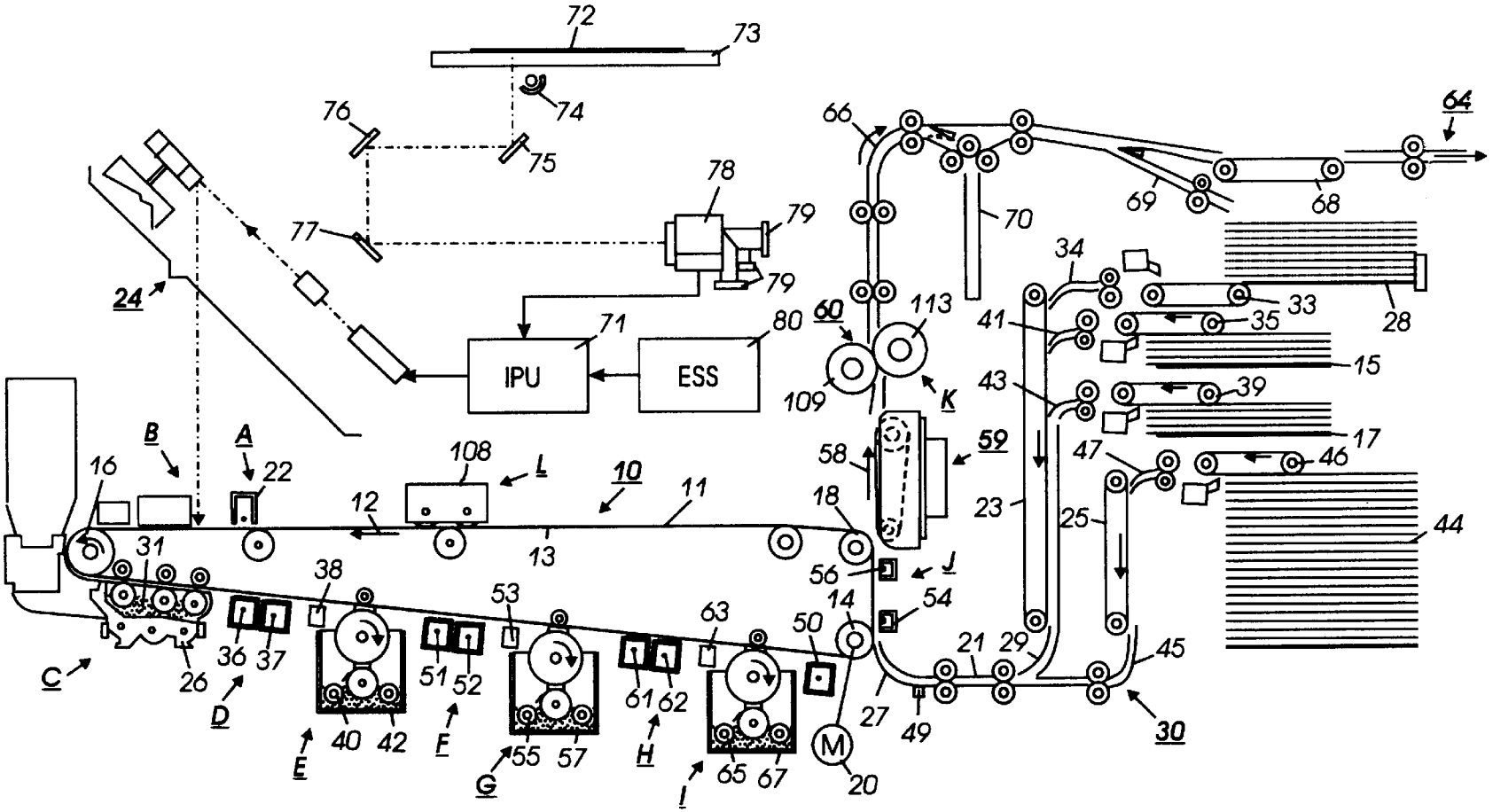
FIG. 1 is a schematic, elevational view depicting an illustrative printing machine.

For a general understanding of the features of the present invention, reference is made to the drawings. In the drawings, like reference numerals have been used throughout to designate identical elements. FIG. 1 schematically depicts an electrophotographic printing machine incorporating the prefuser transport of the present invention therein Inasmuch as the art of electrophotographic printing is well known, the various processing stations employed in the FIG. 1 printing machine will be shown hereinafter and their operation described briefly with reference thereto.

Turning now to FIG. 1, the color copy process typically involves a computer generated color image which may be conveyed to an image processor (IPU) 71, or alternatively a color document 72 may be placed on the surface of a transparent platen 73. A scanning assembly having a light source 74 illuminates the color document 72. The light reflected from document 72 is reflected by mirrors 75, 76, and 77, through lenses (not shown) and a dichroic prism 78 to three charged-coupled linear photosensing devices (CCDs) 79 where image information is read. Each CCD 79 outputs a digital two byte number which is proportional to the strength of the incident light. The digital numbers represent each pixel (picture element) and are indicative of blue, green, and red densities. They are conveyed to the IPU 71 where they are formed into bit maps comprising yellow, cyan, magenta, and black. One skilled in the art will recognize that each bit map represents the exposure, color component, and color separation for each pixel. The IPU 71 stores the bit maps for further instructions from an electronic subsystem (ESS) 80. The ESS is a self-contained, dedicated mini-computer having a central processing unit (CPU), electronic storage, and a display or user interface (UI). It is the control system which prepares and manages the image data flow between IPU 71 and a scanning device 24. Furthermore, ESS 80 is the main multi-tasking processor for operating all of the other machine subsystems and printing operations to be described hereinafter. These operations include imaging, developing, sheet delivery and transfer, plus various functions associated with subsequent finishing processes. Some or all of these subsystems may have additional micro-controllers that communicate with ESS 80.

The printing machine employs a photoreceptor 10 in the form of a belt having a photoconductive surface layer 11 on an electroconductive substrate 13. Preferably the surface 11 is made from an organic photoconductive material. The substrate 13 is preferably made from an aluminum overcoated polymer that is electrically grounded. Other suitable photoconductive surfaces and conductive substrates may also be employed. The belt 10 is driven by means of motor 20 having an encoder attached thereto (not shown) to generate a machine timing clock. Photoreceptor 10 moves along a path defined by rollers 14, 18, and 16 in a counterclockwise direction as shown by arrow 12.

Initially, photoreceptor 10 passes through charging station A where a corona generating device, indicated by reference numeral 22 charges photoreceptor 10 to a relatively high and substantially uniform potential. For purposes of example, photoreceptor 10 is negatively charged, however, it is understood that a positively charged photoreceptor may be used by correspondingly varying the charge levels and polarities of the toners, recharge devices, and other relevant regions or devices involved in the color image formation process.

Next, the charged portion of photoreceptor 10 advances to an imaging station B. Imaging station B exposes photoreceptor 10 to scanning device 24 to discharge the photoreceptor in accordance with the output of the scanning device. The scanning device comprises a laser Raster Output Scanner (ROS). The ROS creates an image in a series of horizontal scan lines having a certain number of pixels per inch. The ROS includes a laser, a polygon mirror, and a suitable modulator (or in lieu of a ROS, a light emitting diode array (LED) write bar may be used). In addition to the image, the ROS writes target marks or indicia on the photoreceptor. Preferably, the target marks proceed or are formed adjacent to the image frame.

At development station C, a magnetic brush developer unit indicated by reference numeral 26 advances developer material 31 into contact with the latent image and latent target marks. Developer unit 26 has a plurality of magnetic brush roller members therein that transport black toner particles to the images for development thereof.

Thereafter, two corona recharge devices 36 and 37, at recharging station D, adjust the voltage levels on photoreceptor 10 to a substantially uniform level. This eliminates the voltage differences between the toned and untoned areas. An imaging station 38 then records a second electrostatic latent image on photoreceptor 10.

At development station E, a developer unit indicated by reference numeral 42 advances developer material 40 having yellow toner particles therein into contact with the second latent image.

Next, corona recharge devices 51 and 52 adjust the photoreceptor voltages at recharging station F to a single uniform level for development of a third image across a uniform electrostatic field. An imaging station 53 then records the third image on the photoreceptor. This image is developed using a magenta colored toner 55 contained in a developer unit 57 disposed at a third developer station G.

At a third recharging station H, corona recharge devices 61 and 62 adjust the photoreceptor voltages to a single uniform level for development of a fourth image across a uniform electrostatic field. An imaging station 63 records the fourth image on the photoreceptor. This image is developed using a cyan colored toner 65 contained in a developer unit 67 disposed at a fourth developer station I.

The developer units 42, 57, and 67 are preferably of the type known in the art which do not interact, or are only marginally interactive with previously developed images. A DC jumping development system, or a powder cloud development system, or a sparse, non-contacting magnetic brush development system are each suitable for use in an image-on-image color development system.

The imaging stations 38, 53, and 63 superimpose subsequent images over the preceding images by selectively discharging the recharged photoreceptor. These imaging stations are similar to imaging station B.

In order to condition the toner for effective transfer to a copy media, a pre-transfer corotron member 50 charges toner particles on photoreceptor 10 to a required magnitude and polarity that ensures proper transfer to the copy media.

A copy media, such as a sheet of paper or a transparency, is advanced to transfer station J by a sheet feeding apparatus 30. During simplex operation (single-sided copy), blank media feeds from tray 15 or tray 17, or a high capacity tray 44 thereunder to a registration transport 21. The registration transport 21 properly positions the sheet with respect to the process and lateral directions, and adjusts the sheet for skew position. Trays 15, 17, and 44 may each hold a different media type. Tray 15, for example, may feed 8.5×11 inch sheets, while tray 17 feeds 11×17 inch sheets, and high capacity tray 44 feeds 14.33×20.5 inch sheets. Alternatively, a wide variety of transparencies can be run through the machine from any one of these trays.

The velocity of the copy media is adjusted at registration transport 21 so that the sheet arrives at transfer station J in synchronization with the image on the surface of photoconductive belt 10. Registration transport 21 receives the media from either a vertical transport 23 or a high capacity tray transport 25 and moves the received media to a pre-transfer baffle 27. The vertical transport 23 receives the media from either tray 15 or tray 17, or the single-sided copy from duplex tray 28, and guides it to the registration transport 21 by way of a turn baffle 29. Feeders 35 and 39 advance the media from trays 15 and 17 to the vertical transport 23 through chutes 41 and 43. The high capacity tray transport 25 receives the media from tray 44 and guides it to registration transport 21 by way of a lower baffle 45. A feeder 46 advances copy media from tray 44 to transport 25 through a chute 47.

The pre-transfer baffle 27 guides the media past registration transport 21 to transfer station J. Pre-transfer baffle 27 is isolated from machine ground to prevent the discharge of photoreceptor 10. Charge limiter 49 located on pre-transfer baffle 27 restricts the amount of electrostatic charge the media can place on baffle 27 to reduce image quality problems and shock hazards. The charge can be placed on the baffle from either the movement of the media through the baffle or by the corona generating devices at transfer station J. When the charge exceeds a threshold limit, charge limiter 49 discharges the excess to ground.

Transfer station J includes a transfer corona device 54 which sprays oppositely charged ions onto the backside of the copy media. This attracts the charged toner powder images from photoreceptor belt 10 to the media. A detack corona device 56 is provided for facilitating stripping of the media from belt 10.

After the lead edge of the copy media strips away from the photoconductive surface of belt 10, it travels beneath a prefuser vacuum transport (PFT) 59, in the direction of arrow 58. The PFT 59 receives the copy media with an unfused image thereon and advances it to fusing station K. The drive force applied to the copy media by PFT 59 is a function of vacuum pressure, contact area (between PFT 59 and the copy media), and the coefficient of friction of a moving belt on PFT 59. PFT 59 is driven slightly faster than photoreceptor belt 10 to maintain tension on the copy media between the photoreceptor and PFT 59. This requires the PFT drive force to be less than the belt 10 holding force. One skilled in the art will recognize that the photoreceptor holding force is a function of the charging parameters of corona generators 54 and 56, the tack zone area between the corona generators, the velocity of the copy media, the geometry of the media path, and the copy quality requirements. PFT 59 will be described hereinafter, in greater detail, with reference to FIG. 2.

Fusing station K includes a fuser assembly, indicated generally by the reference numeral 60, which permanently fixes the transferred color images to the copy media. Preferably, fuser assembly 60 comprises a heated fuser roller 109 and a backup or pressure roller 113. The copy media passes between fuser roller 109 and backup roller 113 with the toner powder image contacting fuser roller 109. In this manner, the toner powder images are permanently fixed to the sheet. When the copy media is a color transparency the fuser velocity is reduced to one half the process speed of PFT 59 to achieve color projectability.

After fusing, chute 66 guides the advancing media to feeder 68 for exit to a finishing module (not shown) at output 64. However, for duplex operation, the media is reversed in position at inverter 70 and transported to duplex tray 28 by chute 69. Duplex tray 28 temporarily collects the media and feeder 33 advances it to the vertical transport 23 through chute 34. The media fed from duplex tray 28 receives an image on the second side thereof, at transfer station J, in the same manner as the image was deposited on the first side thereof. The completed duplex copy exits to the finishing module (not shown) at output 64.

Once the copy media separates from photoreceptor 10, residual toner carried on the photoreceptor surface is removed therefrom. The toner is removed at cleaning station L using a cleaning brush structure contained in a housing 108.

FIG. 1 illustrates an example of a printing machine having the prefuser vacuum transport of the present invention therein to produce a visible image-on-image color output in a single pass or rotation of the photoreceptor. However, it is understood that the prefuser vacuum transport (PFT) of the present invention may be used in a multiple pass color image formation process. In a multi-pass system, each successive color image is applied in a subsequent pass or rotation of the photoreceptor. Furthermore, only a single set of charging devices is needed to charge the photoreceptor surface prior to each subsequent color image formation. For purposes of simplicity, both charging devices can be employed for charging the photoreceptor using the split recharge concept prior to the exposure of each latent image as described hereinbefore to produce the image-on-image output. Alternatively, a controller could be used to regulate the charging step so that only a single recharge device is used to charge the photoreceptor to the desired voltage level for exposure and development thereon. Also, only a single exposure device is needed to expose the photoreceptor prior to each color image development. Finally, in a multi-pass system, the cleaning station is of the type that is capable of sliding away from the surface of the photoreceptor during the image formation process, so that the image is not disturbed prior to image transfer.

Figure 2:
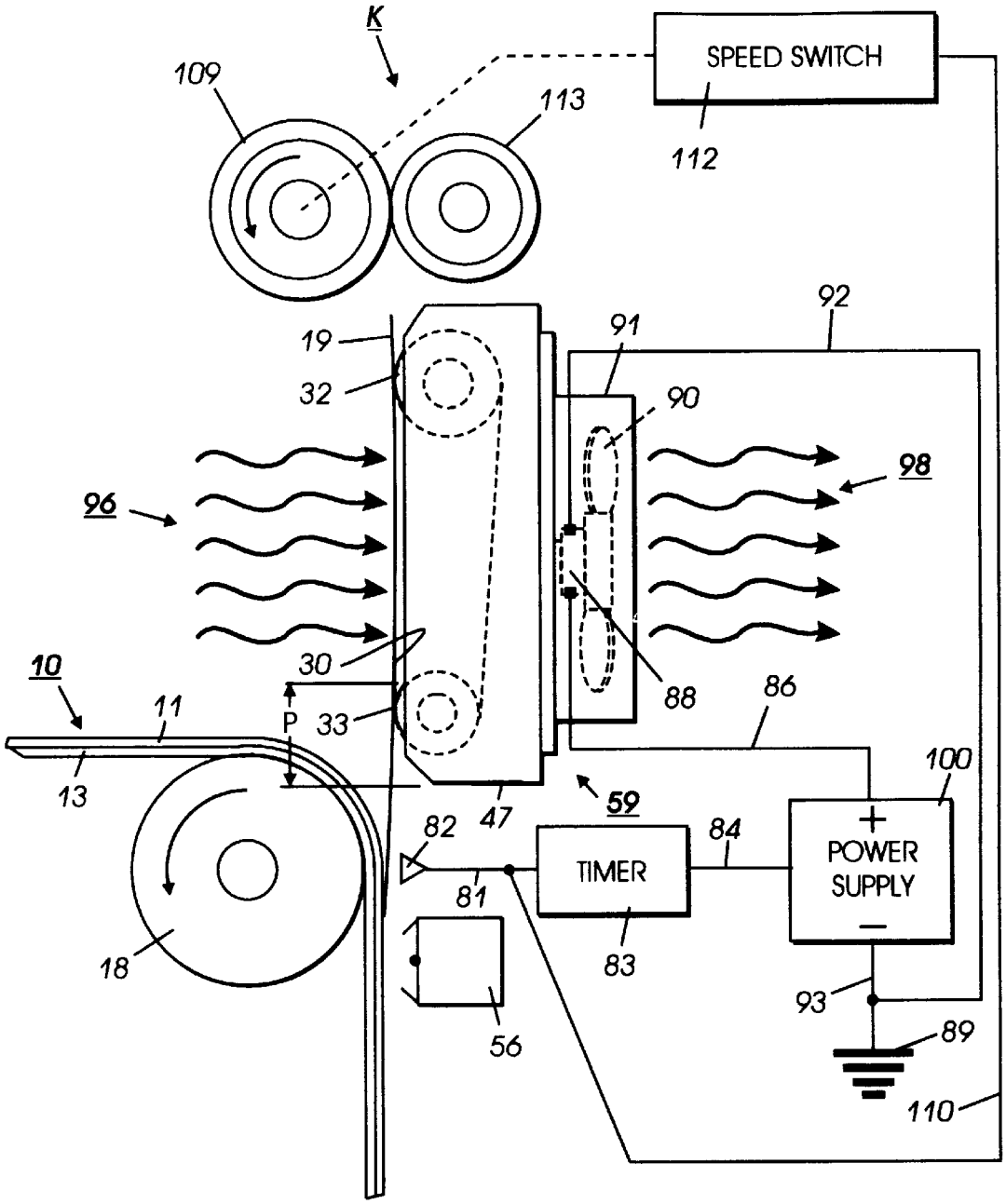
FIG. 2 is a schematic elevational view of a preferred embodiment used in the FIG. 1 printing machine to control vacuum pressure in a prefuser transport in accordance with the present invention.

Turning now to FIG. 2, there is shown a schematic elevational view of the prefuser vacuum transport (PFT) 59 used in the FIG. 1 printing machine. The PFT 59 has a sheet receiving surface for receiving copy media 19, such as a perforated belt 30 entrained over rollers 32 and 33, at least one of which is driven by a motor or driving system (not shown). The perforated belt 30 is driven at a speed that maintains tension on copy media 19 between photoreceptor belt 10 and PFT 59. A plenum 47 communicates with the upper surface of perforated belt 30 so that copy media 19 is drawn thereto. A housing 91, located on the top of plenum 47 contains a vacuum fan 88 having rotating blades 90 mounted thereon to create a negative air pressure or vacuum beneath PFT 59 by drawing in air indicated by arrows 96. Air flow 96 sucks the copy media against a plurality of vacuum holes (not shown) in the perforated belt 30. Air is discharged from the exhaust side of the vacuum fan as indicated by arrows 98. The vacuum fan 88 is connected to a positive terminal on power supply 100 by an electrical conductor 86. The negative terminal of power supply 100 is connected to ground 89 by way of an electrical conductor 93. Likewise, the return side of vacuum fan 88 is connected to ground 89 through an electrical conductor 92 to complete an electrical circuit that energizes the vacuum fan 88. A sensor 82 supplies an electrical signal to a timer circuit 83 through an electrical conductor 81. In a similar manner, the electrical signal from sensor 82 is conveyed to a speed switch 112 by an electrical conductor 110. The speed switch 112 controls the speed of a drive motor (not shown) connected to fuser roll 109. Sensor 82 is of the type that detects and discriminates between paper and transparencies. An electrical output signal, at timer circuit 83, is conveyed to power supply 100 by an electrical conductor 84. On skilled in the art will appreciate that lead 84 terminates at a switching device (not shown) internal to power supply to turn that supply off and on. In this manner, power to the vacuum fan 88 is controlled by an appropriate signal from sensor 82 when a sheet of paper or a transparency passes thereunder.

In FIG. 2, copy media 19 moves past the detack corona generator 56 that neutralizes the transfer charge thereon and enables copy media 19 to strip from belt 10. As copy media 19 passes sensor 82 reflectivity measurements determine whether the copy media is paper or a transparency before the copy media reaches PFT 59, at acquisition zone P. The vacuum sucks the copy media 19 against PFT 59 which advances the copy media along on perforated belt 30. If copy media 19 is a color transparency, then the signal from sensor 82 commands speed switch 112 to reduce the speed of a fuser drive motor (not shown) to a rate equal to one half the process speed of PFT 59. At the same instant, power supply 100 turns off vacuum fan 88 after acquisition for a period of time controlled by timer circuit 83. Turning off vacuum fan 88 reduces the vacuum pressure below the buckle resist force, that is, the vacuum pressure at which the sheet will buckle if the sheet is stopped. The reduced vacuum pressure allows the color transparency to slip on belt 30 while preventing the color transparency from wrapping around fuser roll 109 and causing copy smear. When the vacuum pressure falls below the sheet holding pressure, power supply 100 (controlled by timer circuit 83) turns on vacuum fan 88 to establish proper flow required for PFT 59 to transport a subsequent sheet of copy media. Thus, PFT 59 runs at a constant process speed conveying color transparencies to fuser K, while fuser K runs at a reduced speed to achieve color projectability.

Figure 3:
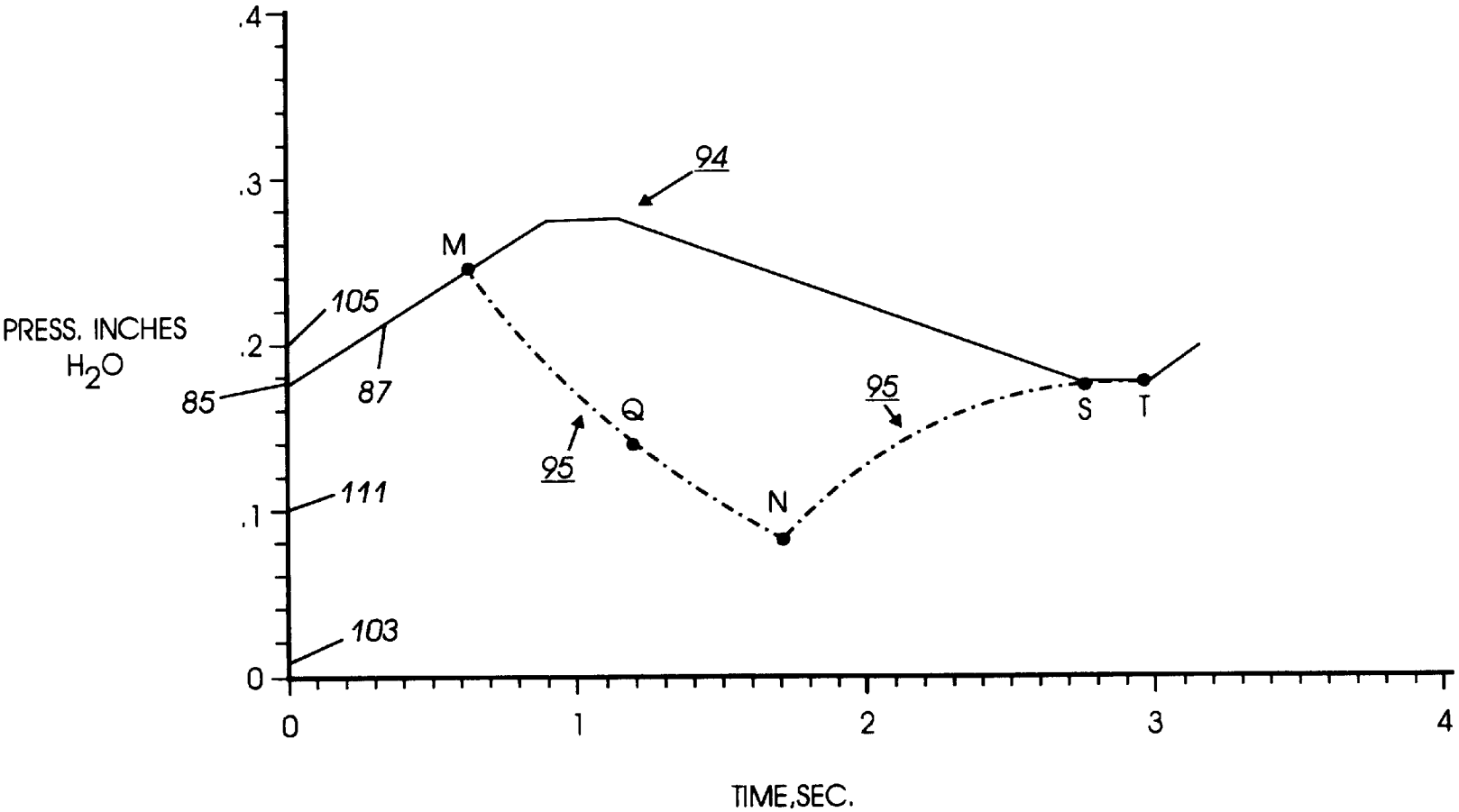
FIG. 3 is a pressure profile graph of the present invention as a color transparency is transported thereon.

FIG. 3 is an exemplary graph illustrating pressure buildup versus time in the PFT plenum when copy media moves thereon. FIG. 3 assumes a PFT process speed having a rate of change of distance with time equal to approximately 186 millimeters per second or 40 prints per minute. Curve 94 represents normal PFT operation for transporting a sheet of paper to fuser K (see FIG. 2) and curve 95 represents PFT operation when transporting a color transparency to the fuser running at half the PFT process speed. The start and end times of the PFT acquisition zone P shown in FIG. 2 are indicated by numeral 85 (at TIME=0 seconds) and numeral 87 (at TIME=0.35 seconds).

Referring to curve 95, the vacuum fan turns off at point M (TIME=0.65 seconds) when a color transparency is detected. With the vacuum fan turned off, the plenum pressure begins to decrease exponentially towards point N (TIME=1.7 seconds) as the transparency moves across the PFT. At point Q (TIME=1.2 seconds), the lead edge of the transparency arrives at the fuser. The pressure at Q is less than the buckle resist force of vacuum pressure 105. Pressure 105 represents the buckle resist force when a maximum coefficient of friction between the transparency and belt 30 (see FIG. 2) equals approximately 1.58. The reduced drive force causes the color transparency to slip on belt 30 (see FIG. 2) slowing down its delivery to the fuser. Consequently, the transparency will not wrap around the fuser roll 109 (see FIG. 2).

Next, the vacuum fan turns on at point N when the vacuum pressure falls below pressure level 111 which is the pressure required to drive a nominal sheet of copy media to the fuser. Likewise, pressure 103 is the pressure required to hold the weight of a paper backed transparency on the PFT. Between points N and T, curve 95 exponentially builds up to establish the proper flow required for the PFT to transport another sheet of copy media to the fuser. At point S (TIME=2.75 seconds), the trail edge of the color transparency leaves the PFT. At point T (TIME=3.0 seconds), the second sheet arrives for acquisition at zone P.

In recapitulation, it is clear that the apparatus of the present invention includes a transport for conveying transparencies to a fuser when the fuser speed is reduced to achieve color projectability of the transparencies. A vacuum fan, in the transport, turns off and then back on, at appropriate times, to allow slipping between the transparency and a transport drive belt. This prevents the transparencies from buckling and wrapping around a fuser roll resulting in copy smear on the transparencies.

While the invention has been described in conjunction with a preferred embodiment thereof, it is evident that many alternatives, modifications, and variations may be apparent to those skilled in the art. Accordingly, it is intended to embrace all such alternatives, modifications and variations that fall within the broad scope and spirit of the appended claims.

What is claimed is:

1. An apparatus for advancing at least two different types of substrates from a moving surface to a fusing station, including:

a transport for receiving a substrate from the moving surface and for advancing said substrate to the fusing station at a constant speed;

a sensor for producing a first signal when said substrate is of a first type and for producing a second signal when said substrate is of a second type;

a fusing station for fusing toner onto said substrate at a first fusing speed when said first signal is produced and at a lower second fusing speed when said second signal is produced; and an air moving device for moving air such that air pressure induces higher drive forces on said substrate on said transport when said first signal is produced and lower drive forces on said substrate on said transport when said second signal is produced.

2. An apparatus according to claim 1, further including a controllable power supply for selectively driving said air moving device.

3. An apparatus according to claim 2, further including a timer operatively connected to said sensor and to said power supply, said timer for inducing said lower drive forces by turning said controlled power supply off for a predetermined period of time when said sensor producing a second signal.

4. An apparatus according to claim 3, wherein said lower drive forces are below a buckle resist force for said second substrate such that said second substrate slips on said transport when said second substrate reaches said fusing station.

5. An apparatus according to claim 4, wherein said second substrate is a transparency.

6. An apparatus according to claim 4, wherein said second substrate is a color transparency.

7. A printing machine for producing fused images on at least two types of substrates, comprising:

a belt for advancing a toner-bearing substrate;

a transport for receiving said toner-bearing substrate from said belt and for advancing said toner-bearing substrate to the fusing station at a constant speed;

a sensor for producing a first signal when said toner-bearing substrate is of a first type and for producing a second signal when said toner-bearing substrate is of a second type;

a fusing station for fusing toner onto said toner-bearing substrate at a first fusing speed when said first signal is produced and at a lower second fusing speed when said second signal is produced; and an air moving device for moving air such that air pressure induces higher drive forces on said toner-bearing substrate on said transport when said first signal is produced and lower drive forces on said toner-bearing substrate on said transport when said second signal is produced.

8. A printing machine according to claim 7, further including a controllable power supply for selectively driving said air moving device.

9. A printing machine according to claim 8, further including a timer operatively connected to said sensor and to said power supply, said timer for inducing said lower drive forces by turning said controlled power supply off for a predetermined period of time when said sensor producing a second signal.

10. A printing machine according to claim 9, wherein said lower drive forces are below a buckle resist force for said second substrate such that said second substrate slips on said transport when said second substrate reaches said fusing station.

11. A printing machine according to claim 7, wherein said second substrate is a transparency.

12. A printing machine according to claim 7, wherein said second substrate is a color transparency.

* * * * *

UNITED STATES PATENT AND TRADEMARK OFFICE

CERTIFICATE OF CORRECTION

PATENT NO. : 6,026,276
DATED : February 15, 2000
INVENTOR(S) : Michael A. Malachowski It is certified that error appears in the above-identified patent and that said Letters Patent is hereby corrected as shown below:

Title Page, after "Inventor", add —[73] Assignee: Xerox Corporation—.

Signed and Sealed this

Fifth Day of June, 2001

*Attest:*

*Attesting Officer*

Nicholas P. Godici

NICHOLAS P. GODICI

*Acting Director of the United States Patent and Trademark Office*